US007014056B2

(12) United States Patent
Trude

(10) Patent No.: US 7,014,056 B2
(45) Date of Patent: Mar. 21, 2006

(54) 4-SIDED CONTAINER WITH SMOOTH FRONT AND BACK PANELS THAT CAN RECEIVE LABELS IN A VARIETY OF WAYS

(75) Inventor: Gregory Trude, Seven Valleys, PA (US)

(73) Assignee: Graham Packaging Company, L.P., York, PA (US)

( * ) Notice: Subject to any disclaimer, the term of this patent is extended or adjusted under 35 U.S.C. 154(b) by 257 days.

(21) Appl. No.: 10/669,792

(22) Filed: Sep. 25, 2003

(65) Prior Publication Data

US 2005/0067369 A1 Mar. 31, 2005

(51) Int. Cl.
*B65D 1/02* (2006.01)
*B65D 23/02* (2006.01)

(52) U.S. Cl. ..... 215/381; 215/383; 220/669

(58) Field of Classification Search ..... 215/379, 215/381, 383, 384; 220/666, 679, 672, 673, 220/675

See application file for complete search history.

(56) References Cited

U.S. PATENT DOCUMENTS

| | | | | |
|---|---|---|---|---|
| 5,199,588 | A * | 4/1993 | Hayashi | 215/381 |
| 5,222,615 | A | 6/1993 | Ota et al. | |
| 5,279,433 | A * | 1/1994 | Krishnakumar et al. | 215/381 |
| 5,341,946 | A * | 8/1994 | Vailliencourt et al. | 215/381 |
| 5,472,105 | A | 12/1995 | Krishnakumar et al. | |
| 5,499,730 | A * | 3/1996 | Harbour | 215/382 |
| 5,762,221 | A | 6/1998 | Tobias et al. | |
| 6,920,992 | B1 * | 7/2005 | Lane et al. | 215/381 |
| 2001/0035392 | A1 * | 11/2001 | Ota et al. | 215/381 |
| 2002/0092821 | A1 | 7/2002 | Hiromichi et al. | |
| 2002/0096486 | A1 * | 7/2002 | Bourque et al. | 215/384 |

FOREIGN PATENT DOCUMENTS

| | | | |
|---|---|---|---|
| EP | 0 469 777 | A1 | 2/1992 |
| EP | 0 590 782 | A1 | 4/1994 |
| EP | 1 298 067 | A1 | 4/2003 |
| EP | 1386844 | A1 * | 2/2004 |
| JP | 2003104347 | A * | 4/2003 |

OTHER PUBLICATIONS

Patent Abstracts of Japan, vol. 2000, No. 3, Mar. 30, 2000; JP 11 34854 A (Toppan Printing Co. Ltd.); Dec. 21, 1999.

* cited by examiner

*Primary Examiner*—Sue A. Weaver
(74) *Attorney, Agent, or Firm*—Venable LLP; James R. Burdett; Keith G. Haddaway

(57) ABSTRACT

A container includes a neck section with a finish, a relatively smooth tapering shoulder section that extends outwardly from a base of the neck section, a body section having four substantially vertical sides including two opposing, relatively smooth vertical sides and two opposing vertical sides with two vacuum panels formed thereon, one vacuum panel on top of the other vacuum panel and separated by substantially horizontal bridge, and a bottom portion adjacent the body section, the bottom section having a standing ring surrounding a recessed area on a bottom surface of the bottom section and relatively smooth walls inclining upwardly from the standing ring toward the body section. The shoulder section is disposed between the body section and the neck section.

19 Claims, 3 Drawing Sheets

4-SIDED CONTAINER WITH SMOOTH FRONT AND BACK PANELS THAT CAN RECEIVE LABELS IN A VARIETY OF WAYS

BACKGROUND OF THE INVENTION

1. Field of the Invention

The present invention relates generally to a container with four sides where the front and back sides are smooth so that a container label can be applied thereon in a variety of ways, and more particularly to a container with two opposing sides with vacuum panels and two other opposing sides that are relatively smooth and void of any geometry.

2. Related Art

Containers are known that are made from a plastic material, such as polyethylene terephthalate (PET), or other thermoplastic material. These containers are blow molded or otherwise formed in a generally circular shape. In order to prevent known plastic containers from bending and collapsing after the container undergoes heat processing where the container holds a warm product that is cooled during a cooling process, it has been generally accepted to provide the sides of the container with vacuum or compression panels. U.S. Pat. Nos. 5,472,105 and 5,762,221 describe such known containers. In this application, the term "heat process" refers to a hot-fill, retort or pasteurization process.

Consequently, known "heat processable" containers made from a plastic material have recessed areas in their sides with strengthening ribs. As a result, there is insufficient room to place a label identifying the product on a side of the container, unless the label covers recessed areas. While a label may cover several recessed areas with strengthening ribs therein, the label does not hide the bumps that a person (consumer) feels when he picks up the container. If everything else about two products are equal, it may be the packaging or feel of the packaging that determines which product the consumer ultimately chooses to purchase. In the competitive area of packaging, plastic material is not as expensive as glass; but a smooth glass-like finish is desired as consumers tend to prefer the feel of smooth glass. That is, a container that is more aesthetic and pleasing to the eye (and fingers) of consumer is desired.

Further, the recessed areas under the label provide a place to collect liquid from melted ice or condensation, which is problematic in that the liquid may leak out of the recessed area when a customer uses the product. In addition, the label may tear easily either due to water from the melted ice and/or pressure into the recessed area when a person grips the container resulting in a ripped label. Thus, the placement of a label over a recessed area with supports is not very secure and may be accidentally torn off by a consumer. This problem of a not very secure label is due to a smaller surface area being glued to the container. Accordingly, there is a need for "heat process" container with smooth sides to enable secure placement of a label identifying the product, without the problems associated with known "heat process" containers.

BRIEF SUMMARY OF THE INVENTION

In summary, a container with smooth opposing panels of a sufficient size to place labels thereon and that is sufficiently rigid so a number of containers can be stacked one above another when filled with a product is needed.

This invention omits an element employed in the prior art without loss of ability.

This invention satisfies a long felt need for a "heat process" container with smooth opposing sides that is sufficiently rigid to enable stacking of filled containers.

This is achieved with a container including a neck section with a finish, a relatively smooth tapering shoulder section extending outwardly from a base of the neck section, a body section having four substantially vertical sides including two opposing, relatively smooth vertical sides and two opposing vertical sides with two vacuum panels formed thereon, one vacuum panel on top of the other vacuum panel and separated by substantially horizontal bridge, and a bottom section adjacent the body section where the bottom section has a standing ring surrounding a recessed area on a bottom surface of the bottom section and relatively smooth walls inclining upwardly from the standing ring toward the body section. The shoulder section of the container according to the invention is disposed between the neck section and the body section.

In a second embodiment, a container according to the invention provides smooth surfaces on opposing sides of the container so that the same are adapted to receive labels in a variety of ways. This container includes a neck section, a bell portion curving outwardly and downwardly from the neck section to an upper circumscribing area, a body section formed of four separate side panels including two opposing, relatively smooth vertical sides and two opposing vertical sides with two vacuum panels formed thereon, one vacuum panel on top of the other vacuum panel and separated by a substantially horizontal bridge where the two relatively smooth, opposing side panels are adapted to receive a label, and a bottom section adjacent the lower circumscribing area and having a standing ring and a recessed area on a bottom surface of the bottom section. In this embodiment, the body portion extends from the upper circumscribing area to a lower circumscribing area.

In an exemplary embodiment, the vacuum panels may be in the form of the letter "H" so that each recessed vacuum panel has an upper recessed area and a lower recessed area separated by a horizontal bridge that extends to adjacent vertical posts.

In yet another exemplary embodiment, adjacent vertical sides of the container are separated by a vertical post that runs the length of an adjacent vertical side and the container, according to invention, is formed so that the two opposing, relatively smooth, substantially vertical side panels curve outwards from one vertical post to a mid-section of an adjacent relatively smooth, substantially vertical side. Similarly, the two opposing vertical sides with a vacuum panel may be curved outwardly slightly compared to the curve of the two opposing, relatively smooth vertical sides.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Figure 1:
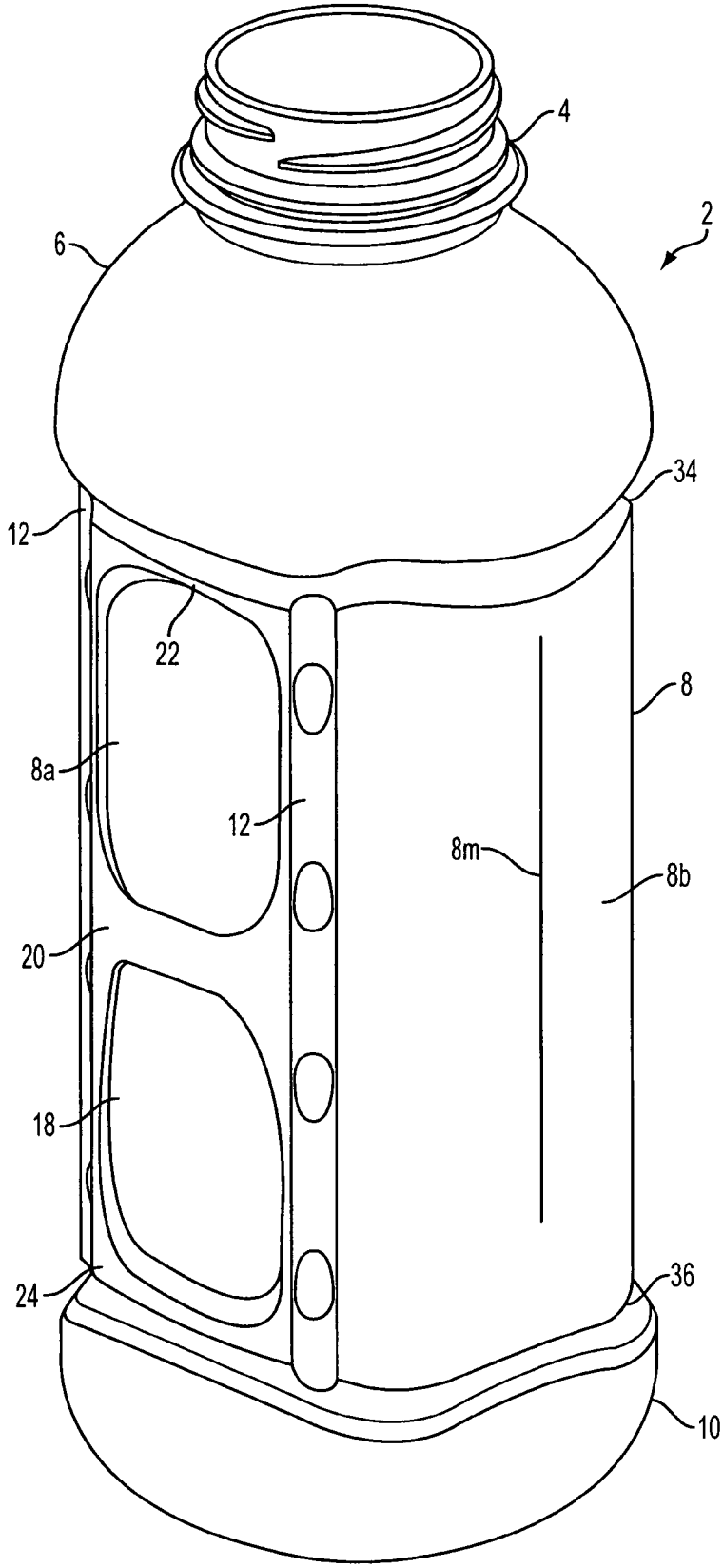
FIG. 1 is a perspective view of an exemplary embodiment of a four-sided container according to the present invention.
Figure 4:
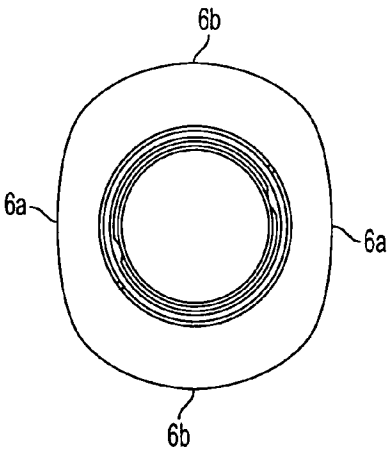
FIG. 4 is a top view of FIG. 1 or FIG. 3 of the present invention.
Figure 5:
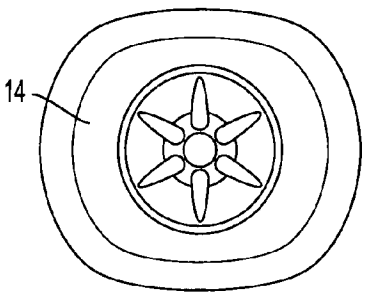
FIG. 5 is a bottom view of the container according to the present invention.

Looking at FIG. 1 of the drawings, a container 2 according to an exemplary embodiment of the invention can be made of thermoplastic material, such as PET. Container 2 includes a neck section 4 with a finish, a relatively smooth tapering shoulder section or bell portion 6, a body section 8, and a bottom section 10. The tapering shoulder section 6 extends outwardly from a base of the neck section 4 and curves downwardly to just above the body section 8. The tapering shoulder section 6, as shown in the top view of FIG. 4, may have two opposing curve sections 6*a*, 6*b* (perpendicular to longitudinal axis A of container 2) where curve section 6*b* extends outwardly more from neck section 4 than curve section 6*a*. While the tapering shoulder section 6 is disclosed as relatively smooth, it may include an embossed logo or other indicia.

Body section 8 has four substantially vertical sides 8*a*, 8*b* where two opposing side panels 8*a* have a different cross-sectional curvature than the two opposing side panels 8*b*. Two opposing side panels 8*b* are relatively smooth and are adapted to receive a label in a variety of ways, such as heat transfer labels, pressure sensitive labels or a paper label. The crosswise curvature of the relatively smooth, opposing panels 8*b* can be greater (as illustrated) than the curvature of the remaining, opposing side panels 8*a*. While the curvature of opposing panels 8*b* would be greater than that of side panels 8*a*, the radius of a cross-sectional curve through side panels 8*b* should be smaller than the underlying geometry of side panels 8*a* in order to function properly. If the radius of the curvature of side panel 8*b* is larger than that of the curvature of side panel 8*a*, the smooth panels will pull in (deform) and the package will not be "label-able". In a preferred embodiment, the radius of the curvature of side panel 8*b* (R1) and the radius of the curvature of side panel 8*a* (R2) would be such that R2 is greater than or equal to 2*R1.

Figure 2:
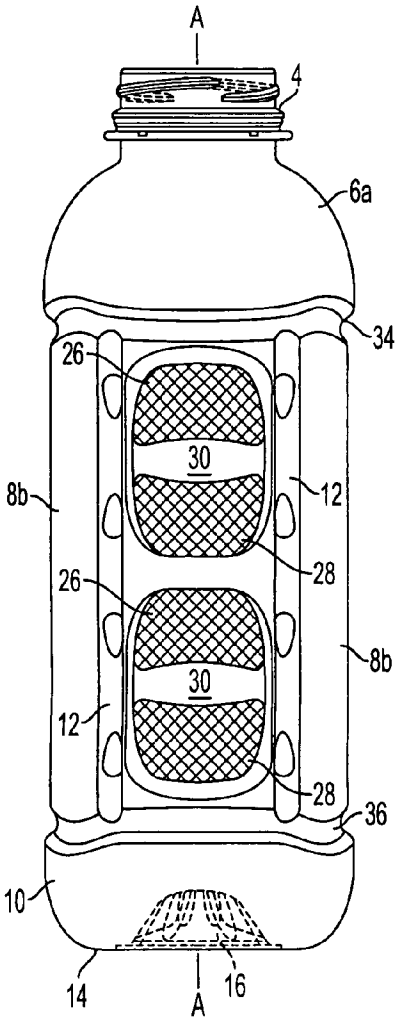
FIG. 2 is a side view of another exemplary embodiment of a four-sided container according to the present invention.
Figure 6:
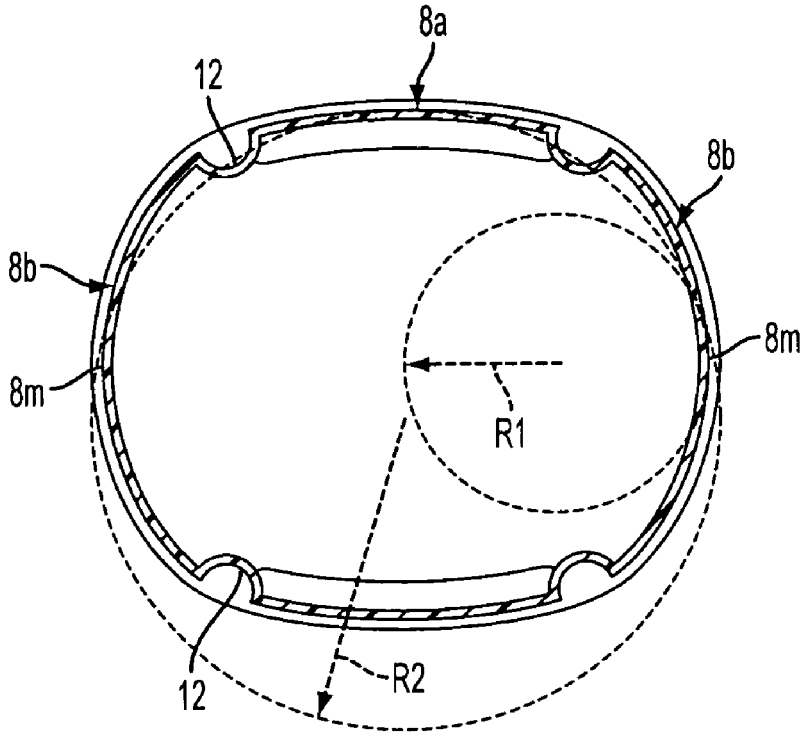
FIG. 6 is a cross-sectional view taken along line VI—VI of FIG. 3.

In the exemplary embodiment, the curvature of the opposing side panels 8*a* is slight and almost flat compared to the cross-wise curve of relatively smooth, opposing panels 8*b*. Adjacent vertical sides 8*a*, 8*b* are separated by a substantially vertical post 12 that runs the length of an adjacent vertical side. In that the substantially vertical side panels 8*b* have a crosswise curvature that extends further from the longitudinal axis A of the container 2, a cross-section of container 2 is approximately elliptical. That is, the two opposing, relatively smooth vertical sides 8*b* are curved outwards from one vertical post 12 to a mid-section 8*m* of an adjacent relatively smooth vertical side that is parallel to longitudinal axis A of container 2. As a result, substantially vertical side panels 8*b* are wider than substantially vertical side panels 8*a* along a direction perpendicular to longitudinal axis A of container 2. Consequently, substantially vertical posts 12 are closer together in the side view shown in FIG. 2, than in the side view of FIG. 3. The position of substantially vertical posts 12 enables body section 8 to be sufficiently rigid so that a number of containers 2 can be stacked one above another when filled with a product.

The crosswise (i.e., perpendicular to the longitudinal axis of container 2) curvature of tapering shoulder section 6 approximates the curvature of each opposing side panel 8*a*, 8*b*. Thus, curved sections 6*a* are located above substantially vertical side panels 8*a* and are dimensioned so that there is a smooth transition between curved sections 6*a* and substantially vertical side panels 8*a* of container 2. Likewise, curved sections 6*b* are located above substantially vertical side panels 8*b* and are dimensioned so that there is a smooth transition between curved sections 6*b* and substantially vertical side panels 8*b* of container 2.

Bottom section 10 is adjacent body section 8 and curves in a relatively smooth fashion toward a standing ring 14. The standing ring 14 is part of a bottom surface of bottom section 10 that is adapted to enable the container to stand by itself on a flat surface. Bottom section 10 has relatively smooth walls curving upwardly from standing ring 14 toward the body section 8. The bottom surface of the bottom section 10 further includes a recessed area 16. Recessed area 16 may be ribbed for structural support of the container base. The ribbed structure prevents the base from popping out during the "heat process". The ribs and structure of recessed area 16 provide structure that enables good material distribution during blow molding, for example. A preferred container 2 may have a 24 oz. volume and a wide neck section 4 that is approximately the width of vertical side panel 8*a*.

Figure 3:
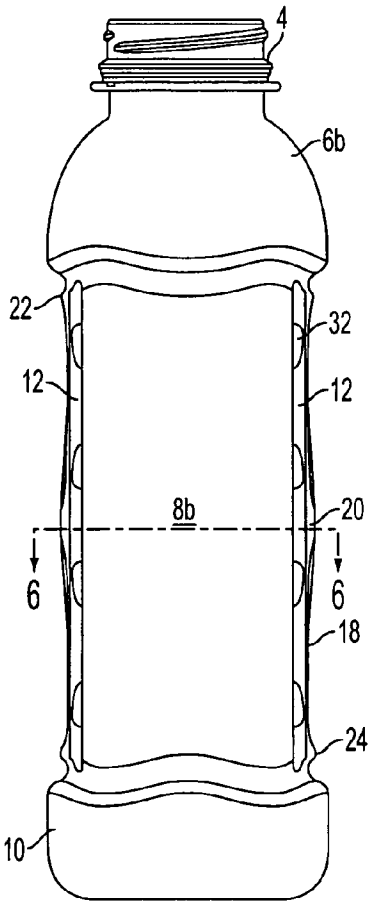
FIG. 3 is another side view, 90° rotation from the side view of FIG. 2.

Substantially vertical side panels 8*a* are formed with a vacuum panel 18 thereon. As shown in FIG. 1, two vacuum panels 18, one on top of the other, are recessed into each substantially vertical side panel 8*a*. The two vacuum panels 18 are separated by substantially horizontal bridge 20. Substantially horizontal bridge 20, as well as the upper ridge 22 and lower ridge 24 on substantially vertical side panel 8*a*, has approximately the same curvature as curve section 6*a* positioned above substantially vertical side panel 8*a*. Thus, as shown in FIG. 3, substantially horizontal bridge 20, as well as upper ridge 22 and lower ridge 24 curve outwardly from the recessed vacuum panel 18. It is envisioned that the substantially horizontal bridge 20 may have a rib or it may not have a rib, if bridge 20 has a heavier plastic weight than that of the vacuum panels. As a result of the substantially horizontal bridge 20 and the upper and lower ridges 22, 24, container 2 is provided with horizontal stability and rigidity is added to the vertical side panel with the vacuum panels 18 of the container 2. In another exemplary embodiment, individual vacuum panels may be designed with etched grip areas 26, 28 in the shape of the letter "H" so that it appears that each recessed vacuum panel has an upper area 26 and a lower area 28 separated by a smooth bridge 30 that extends to vertical posts 12 on either side of the recessed vacuum panel. If a surface etching is provided on recessed vacuum panels 18, the shape or design of the vacuum panel 18 is not limited to the "H" shape shown.

As described above, each substantially vertical post 12 extends along the substantially vertical height of adjacent panels 8*a*, 8*b*. A number of spaced recessed areas 32 may be spaced at the pre-determined intervals along each substantially vertical post 12 that runs the length of an adjacent side 8*a*, 8*b*. The spaced recess areas are designed to mimic the etched grip areas 26, 28 and result in an aesthetically pleasing container 2. In addition to aesthetics, recessed areas may reduced the gram weight or amount of thermoplastic material used to form container 2. The substantially vertical post 12 may be recessed between adjacent substantially vertical side panels 8*a*, 8*b* so that a groove extends from just above an upper portion of a vertical side panel 8*a*, 8*b* along the side of the vertical side panel to just below a bottom portion of the vertical side panel 8*a*, 8*b*.

In the exemplary embodiments illustrated, the transition area between the tapering shoulder section 6 and the body section 8 is an upper circumscribing area 34. Similarly, the transition area between the body section 8 and the bottom section 10 is a lower circumscribing area 36. In an exemplary embodiment, the upper and lower circumscribing areas are grooves between the respective, two adjacent sections. Alternatively, the upper and lower circumscribing areas may be flush or ribbed areas that connect the adjacent sections. In such an exemplary embodiment, each vertical post 12 may be recessed between adjacent vertical panels 8*a*, 8*b*, and each vertical post 12 may extend into upper and lower circumscribing areas 34, 36. When the upper and lower circumscribing areas 34, 36 are grooves, the vertical post 12 may be recessed into the grooves of the upper and lower circumscribing areas 34, 36.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A container comprising:

a neck section with a finish;

a relatively smooth tapering shoulder section extending outwardly from a base of the neck section;

a body section having four substantially vertical sides each separated by a vertical post that runs the length of an adjacent vertical side, said four substantially vertical sides including two opposing, relatively smooth vertical sides and two opposing vertical sides with a vacuum panel formed on each opposing vertical side where a radius of a cross-sectional curve through the relatively smooth vertical sides is smaller that the radius of a cross-sectional curve through an opposing vertical side with a vacuum panel, said shoulder section being disposed between the neck section and said body section; and a bottom section adjacent said body section, said bottom section having a standing ring surrounding a recessed area on a bottom surface of said bottom section and relatively smooth walls inclining upwardly from the standing ring toward said body section.

2. The container according to claim 1, wherein the vacuum panels are provided with a surface etching.

3. The container according to claim 1, wherein the vertical post running the length of an adjacent vertical side has a number of spaced recessed areas.

4. The container according to claim 1, wherein the vertical post running the length of an adjacent vertical side is recessed between the adjacent vertical sides.

5. The container according to claim 1, further comprising a circumscribing groove between said shoulder section and said body section.

6. The container according to claim 1, further comprising a circumscribing groove between said bottom section and said body section.

7. The container according to claim 1, wherein the container is made from a thermoplastic material.

8. The container according to claim 1, wherein said body section has a longitudinal axis and each of the two opposing, relatively smooth vertical sides are curved outwards from one vertical post to a mid-section of the respective relatively smooth vertical side adjacent the one vertical post where the mid-section is parallel to the longitudinal axis.

9. The container according to claim 1, wherein said body section has a longitudinal axis and each of the two opposing, relatively smooth vertical sides are curved outwards from one vertical post to a mid-section of the respective relatively smooth vertical side adjacent the one vertical post where the mid-section is parallel to the longitudinal axis and the two opposing vertical sides with a vacuum panel are curved outwardly slightly compared to the curve of the two opposing, relatively smooth vertical sides.

10. The container according to claim 1, wherein an opposing vertical side with a vacuum panel has two vacuum panels formed thereon where one vacuum panel is disposed on top of the other vacuum panel and the vacuum panels are separated by a substantially horizontal bridge.

11. A container for providing smooth surfaces adapted to receive labels in a variety of ways, said container comprising:

a neck section with a finish;

a bell portion curving outwardly and downwardly from the neck section to an upper circumscribing area;

a body section formed of four separate side panels each separated by a vertical post that runs the length of an adjacent vertical side, said four side panels including two opposing, relatively smooth vertical sides and two opposing vertical sides with a vacuum panel formed on each opposing vertical side where a radius of a cross-sectional curve through the relatively smooth vertical sides is smaller that the radius of a cross-sectional curve through an opposing side with a vacuum panel and the two relatively smooth, opposing sides are adapted to receive a label, said body section extending from the upper circumscribing area to a lower circumscribing area; and a bottom section adjacent said lower circumscribing area and having a standing ring and a recessed area on a bottom surface of the bottom section.

12. The container according to claim 11, wherein the upper and lower circumscribing areas are grooves.

13. The container according to claim 11, wherein said bottom section has relatively smooth walls inclining upwardly from the standing ring toward said body section.

14. The container according to claim 11, wherein the two vacuum panels are provided with a surface etching.

15. The container according to claim 11, wherein each vertical post is recessed between adjacent sides of said body section.

16. The container according to claim 11, wherein said body section has a longitudinal axis and each of the two opposing, relatively smooth, substantially vertical sides are curved outwards from one vertical post to a mid-section of the respective relatively smooth, substantially vertical side adjacent the one vertical post where the mid-section is parallel to the longitudinal axis.

17. The container according to claim 16, wherein each of the two opposing vertical sides with a vacuum panel are curved outwardly slightly compared to the curve of the two opposing, relatively smooth vertical sides.

18. The container according to claim 11, wherein the container withstands the pressures associated with at least one of a hot-filled, retort and pasteurization process.

19. The container according to claim 11, wherein an opposing vertical side with a vacuum panel has two vacuum panels formed thereon where one vacuum panel is disposed on top of the other vacuum panel and the vacuum panels are separated by a substantially horizontal bridge.

* * * * *